US006058582A

United States Patent [19]

Gardner et al.

[11] Patent Number: 6,058,582

[45] Date of Patent: May 9, 2000

[54] NAPPER MACHINE

[75] Inventors: Joseph M. Gardner; Willis J. Antonovich, both of Springfield, Vt.

[73] Assignee: Parks & Woolson, Springfield, Vt.

[21] Appl. No.: 09/012,391

[22] Filed: Jan. 23, 1998

Related U.S. Application Data

[60] Provisional application No. 60/060,923, Oct. 3, 1997.

[51] Int. Cl.[7] ..... D06C 11/00

[52] U.S. Cl. ..... 26/33; 26/29 R

[58] Field of Search ..... 26/33, 31, 30, 26/29 P, 37, 36, 29 R, 32, 25, 27, 28; 492/21, 12, 29, 30, 46

[56] References Cited

U.S. PATENT DOCUMENTS

| | | | |
|---|---|---|---|
| Re. 13,695 | 3/1914 | Greene | 26/33 |
| 140,320 | 6/1873 | Tompkins et al. . | |
| 151,957 | 6/1874 | Brown . | |
| 172,690 | 1/1876 | Becker . | |
| 459,354 | 9/1891 | Wood . | |
| 466,642 | 1/1892 | Woelfel . | |
| 494,152 | 3/1893 | Martinot . | |
| 504,010 | 8/1893 | Wilson . | |
| 544,682 | 8/1895 | McGenniss . | |
| 558,353 | 4/1896 | Cochrane . | |
| 600,885 | 3/1898 | Musgrove . | |
| 647,323 | 4/1900 | O'Brien . | |
| 847,323 | 3/1907 | Dennis et al. . | |
| 1,007,237 | 10/1911 | Praray et al. | 26/33 |
| 1,016,174 | 1/1912 | Praray et al. | 26/33 |
| 1,019,515 | 3/1912 | Mullers | 26/33 |
| 1,082,992 | 12/1913 | Baum . | |
| 1,240,194 | 9/1917 | Gessner | 26/33 |
| 1,702,696 | 2/1929 | Kelso . | |
| 1,720,252 | 7/1929 | Whittaker | 26/33 |
| 1,880,486 | 10/1932 | Richardson . | |
| 2,126,629 | 8/1938 | Fleisher . | |
| 2,129,877 | 9/1938 | Runton . | |
| 2,225,878 | 12/1940 | Merriman . | |
| 2,238,560 | 4/1941 | Fleisher . | |
| 2,305,526 | 12/1942 | Hadley . | |
| 2,340,069 | 1/1944 | McCarthy et al. | 26/31 |
| 2,472,584 | 6/1949 | Hadley . | |
| 2,698,476 | 1/1955 | Hadley . | |
| 2,707,815 | 5/1955 | Hadley . | |
| 2,716,747 | 8/1955 | Crossland . | |
| 2,716,797 | 9/1955 | Hadley . | |
| 2,730,113 | 1/1956 | Hadley . | |
| 2,749,593 | 6/1956 | Hadley . | |
| 2,754,565 | 7/1956 | Hadley . | |
| 2,923,046 | 2/1960 | Scholaert . | |
| 2,923,998 | 2/1960 | Miessen | 26/33 |
| 3,132,786 | 5/1964 | Davidson . | |
| 3,328,862 | 7/1967 | Mullers | 26/33 |
| 3,610,496 | 10/1971 | Parker | 226/42 |
| 3,645,433 | 2/1972 | Lucas et al. | 226/190 |
| 3,838,481 | 10/1974 | Kuroda | 26/67 |
| 3,902,231 | 9/1975 | McKinney | 28/1.6 |
| 3,948,709 | 4/1976 | Ida et al. | 156/209 |
| 4,073,043 | 2/1978 | Lowder | 26/33 |
| 4,274,182 | 6/1981 | Greenway | 26/2 R |
| 4,311,242 | 1/1982 | Hnatko | 209/668 |

(List continued on next page.)

FOREIGN PATENT DOCUMENTS

| | | | |
|---|---|---|---|
| 191478 | 7/1888 | France | 26/33 |
| 580386 | 11/1924 | France | 26/33 |
| 281288 | 11/1926 | Germany | 26/33 |
| 5241 | of 1880 | United Kingdom | 26/31 |

*Primary Examiner*—Amy B. Vanatta
*Attorney, Agent, or Firm*—Hamilton, Brook, Smith & Reynolds, P.C.

[57] ABSTRACT

A napper fabric processing machine implements a number of improvements. First, the worker rolls are aluminum, reducing their weight and attachable to the cylinder using a quick release mechanism, enabling quick replacement. The worker roll are also easily serviceable and accessible from the side of the machine. Further, carding wear is monitored electrically by detecting torque generated by the motors driving the worker rolls. Finally, a tensioning system is used for the drive belts, negating the need for cylinder disassembly to replace the belts.

22 Claims, 12 Drawing Sheets

U.S. PATENT DOCUMENTS

| | | | |
|---|---|---|---|
| 4,372,004 | 2/1983 | Vermillion | 15/182 |
| 4,463,483 | 8/1984 | Holm | 26/29 P |
| 4,480,363 | 11/1984 | Segura | 26/29 R |
| 4,645,109 | 2/1987 | Fleissner | 226/42 |
| 4,676,943 | 6/1987 | Stockmeyer | 264/288.4 |
| 4,803,761 | 2/1989 | Lungers | 26/35 |
| 4,922,589 | 5/1990 | Busch | 26/29 R |
| 4,993,650 | 2/1991 | Nickell | 242/18 R |
| 5,084,948 | 2/1992 | Nielsen et al. | 26/32 |
| 5,233,719 | 8/1993 | Young et al. | 492/29 |
| 5,288,220 | 2/1994 | Kugler et al. | 26/30 |
| 5,441,106 | 8/1995 | Yukitake | 165/183 |
| 5,480,085 | 1/1996 | Smithe et al. | 226/44 |
| 5,503,349 | 4/1996 | Chertok | 242/422.2 |
| 5,517,736 | 5/1996 | Dalla Vecchia | 26/33 |
| 5,528,804 | 6/1996 | Dalla Vecchia | 26/33 |
| 5,566,723 | 10/1996 | Alexander, III | 139/1 B |
| 5,611,396 | 3/1997 | Reed | 165/300 |
| 5,681,251 | 10/1997 | Shew | 492/46 |

NAPPER MACHINE

RELATED APPLICATION

This application claims the benefit of U.S. Provisional Appl. Ser. No. 60/060,923, filed Oct. 3, 1997, the entire teachings of which are incorporated herein by this reference.

BACKGROUND OF THE INVENTION

Nappers are typically large fabric processing machines that raise fuzz, termed pile or nap, on the surface of woven or knitted fabrics.

In most modern napper designs, unprocessed fabric enters the machine and passes over a series of rolls, known as worker rolls, that are themselves arranged around a cylinder. The worker rolls are driven to rotate either all against, or alternatively with and against, the direction of fabric progress. The cylinder is driven in relationship to the direction of fabric progress. In a double-acting mode in which the worker rolls are alternately driven with and against the direction of fabric progress, the cylinder rotates with the fabric. The cylinder rotates in the opposite direction when processing knit fabrics.

The worker roll surfaces are covered with sharp, densely packed hooked or straight wires, termed carding, which tug at the surface of the fabric. This process pulls and breaks the fabric fiber, creating the nap in the processed fabric.

SUMMARY OF THE INVENTION

By virtue of the napper machines' operation, it is subject to wear and periodically requires service. The worker rolls in some designs rotate over one thousand revolutions per minute (rpms) and are held on a cylinder that itself rotates, abeit somewhat more slowly. And, all of this occurs under the loading of the fabric. Moreover, the worker roll carding is exposed to direct wear as it is scraped along the fabric surface and is then cleaned.

Napper repair and reconditioning, however, has typically been difficult to accomplish. The napper's main components are typically large and heavy, rendering them awkward to disassemble and reinstall, thus making maintenance and repair very time consuming.

For example, the worker rolls have historically been constructed from steel to support the fabric loading at the operating speeds and withstand the generated torques. Moreover, the bearings for the worker rolls were housed in the cylinder in a fashion requiring substantial disassembly to remove individual rolls from the cylinder.

The cleaner rolls, commonly referred to as fancies, that remove accumulated flock from the worker rolls also require periodic service to replace the cleaning elements, typically wire brush fillet. Because the cleaner rolls have been located under the cylinder where they are difficult to access and with the fillet being bolted to the rolls, replacing cleaning elements had required a lengthy shut down of the machine.

Further, the wire carding on the surfaces of the worker rolls is subject to wear resulting from their constant engagement with the fabric being processed. Generally, the wire must be replaced after several months, but assessment of whether the wire had been worn to the stage where they must be replaced could only be performed by an experienced operator. The machine had to be stopped, and a large number of the worker rolls closely inspected.

Still further, nappers are either gear or belt driven. On current belt-driven nappers, belt replacement requires a complicated disassembly of the machine.

The inventive fabric processing machine is directed to a number improvements. First, the worker rolls are aluminum, preferably extruded, reducing their weight, and attached to the cylinder using a quick-release mechanism, facilitating replacement. The cleaner rolls or fancies are also easily serviceable using another quick-release system and accessible from the side of the machine. Further, carding wear is assessed electrically by monitoring torque and its rate of change generated by the motors driving the worker rolls. Finally, a tensioning system is used for the drive belts negating the need for disassembly of the cylinder to replace the belts.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

1. General details of napper construction

Figure 1:
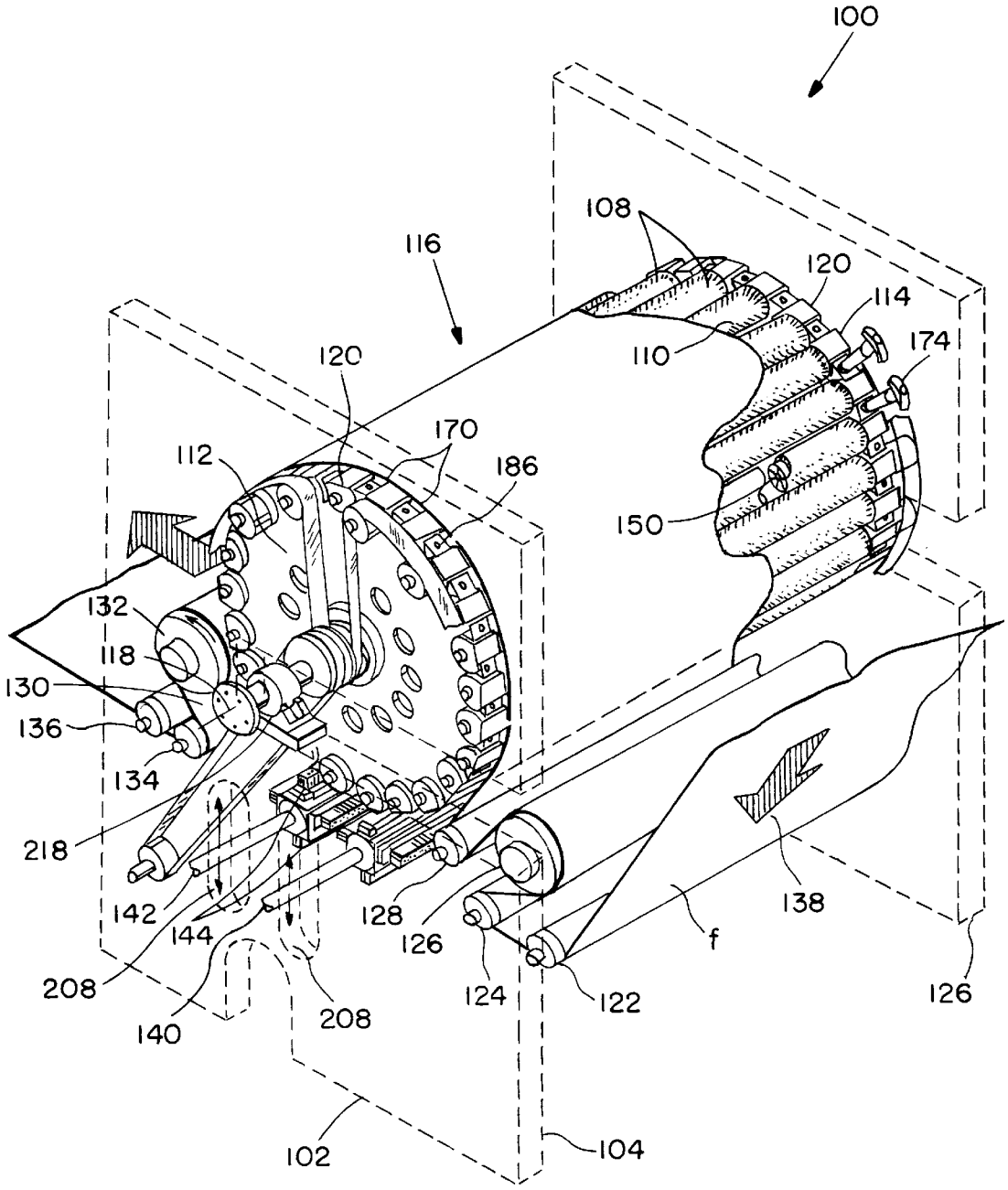
FIG. 1 is a perspective schematic and partially cut-away view of a fabric surface processing machine 100 of the present invention.

FIG. 1 shows a fabric surface processing machine 100, which has been constructed according to the principles of the present invention. In the preferred embodiment, it is configured as a napper that develops a nap or raised fuzz on the surface of knitted or woven fabric f.

Generally, the machine 100 comprises a frame 102 having a base (not shown in this view) running largely horizontally at the bottom of the machine and left and right end-pieces 104, 106 that project upwards from the base to support the machine's superstructure of a large rotating cylinder 116.

The principal fabric processing components of the machine 100 are the worker rolls 108. The working surfaces of these rolls are covered with densely-packed hooked wires 110, known as carding. The worker rolls 108 are supported between left and right cylinder heads 112, 114 of the cylinder 116. Bearing cartridges 120 at each end of the worker rolls 108 secure the rolls to the cylinder heads 112, 114, while allowing the worker rolls 108 to rotate on the cylinder 116. The cylinder 116 is in turn supported between the end-pieces 104, 106 by cylinder bearings 218. The worker rolls 108 are arranged circumferentially around the cylinder heads 112, 114, parallel to the cylinder's axis of rotation 118 on axle 200, and typically number between 18 and 30, depending on the implementation.

Fabric f entering the machine 100 passes over upstream idler rollers 122, 124, which control the fabric's tension, and then over an upstream draft roller 126, which is driven to pull the fabric into the machine 100. An upstream direction-changing roller 128 holds the fabric f against the worker rolls 108. From roller 128, the fabric web f passes over the arc of the worker rolls 108 through most of the cylinder heads' circumference, in the preferred implementation. Fabric then leaves the worker rolls 108 at a downstream direction-changing roller 130. A downstream draft roller 132 is driven to pull the fabric through the machine and two downstream idler rollers 134, 136 control downstream tension.

The fabric's surface is processed through interaction with the carding 110 on the worker rolls 108. The cylinder 116 rotates counter-clockwise, in illustrated implementation, or in the direction of fabric travel (see arrow 138). Contrastingly, in a knit fabric mode, the cylinder direction is reversed to rotate in a clockwise direction, against the direction of fabric progress. In either mode, the cylinder's speed is approximately 90 revolutions per minute (RPMs).

The worker rolls 108 are also driven differently depending on the mode of operation. In a single-action mode, the worker rolls 108 rotate all counter to the direction of fabric movement, i.e., clockwise in the illustrated implementation. For other types of fabric processing, the machine 100 is reconfigurable so that some worker rolls 108 rotate with the direction of fabric progress and other worker rolls rotate against fabric movement, in an alternating arrangement. This is termed a double-acting mode. In either the double- and single-acting mode, the worker rolls rotate typically at speeds around 1000 RPM to brush the fabric surface to draw and break individual fibers into a surface nap.

2. Worker roll construction

Figure 2:
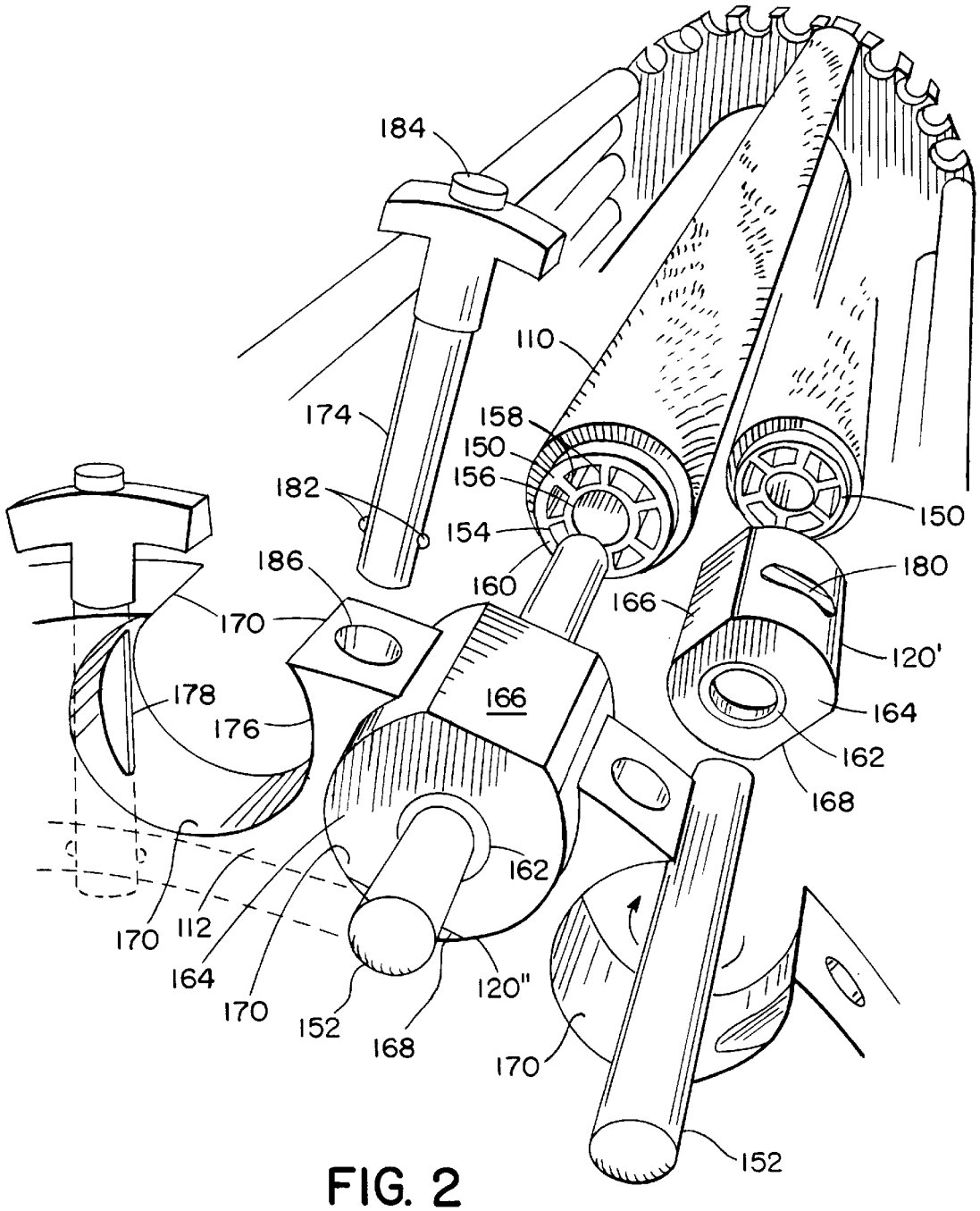
FIG. 2 is an exploded perspective view of an exemplary worker roll and cylinder head of the present invention.

FIG. 2 is a perspective view showing the construction of the worker rolls 108. Generally, the each worker roll 108 comprises a lightweight metal or composite, preferably extruded aluminum, tube 150 on which the carding 110 is wrapped. Gudgeons 152 are press fit into either end of the tube 150, and bearing cartridges 120', 120" are inserted onto the gudgeons 152.

The carding 144 comprises densely-packed hooked or straight wires that extend generally radially from the surface of the tube 150, projecting approximately a few millimeters. As is also common, this carding is preferably a long adhesive strip that is wound around the extruded aluminum tube 150 in a helix fashion. This allows easy replacement of the carding by rotating the aluminum tube 150 and simultaneously stripping the carding from it and then reversing the process to place new carding on the aluminum tube 150.

In order to improve the rigidity of the lightweight materials used, an internal web 154 is used within the tube 150. The web 154 comprises an inner tube 156 and radial, spline-like projections 158 connecting the inner tube 156 with the outer tube 160. The inner tube 156, outer tube 160 and the projections 158 are preferably a single, unitary aluminum extrusion.

In other embodiments, different lightweight metals are substituted for aluminum, such as titanium or magnesium. Aluminum, however, is preferred because of its lower cost relative to titanium and its easier workability relative to magnesium. Carbon-polymer composites represent a more viable substitution. It should be noted that with any of these materials the internal web is important to achieving the desired rigidity.

The outer diameter OD of the outer tube 160 is preferably 2.75 inches, and the inner diameter ID of the inner tube 156 is preferably 1 inch. The length of the tube should be long enough to accommodate standard size fabric widths. Consequently, it is usually one of four lengths: 80 inches, 96 inches, 108 inches, and 120 inches.

In the preferred embodiment, the combination of the aluminum construction and the inner web 154 provides each worker roll 108 with lightweight, yet rigid construction. The inventive aluminum worker rolls are approximately 25% lighter than comparable steel tube worker rolls that are universally employed in nappers and rollers used in other fabric processing machines, previously.

The reduced weight provides two advantages. First, the worker rolls 108 are more easily managed by a single repairman. This facilitates the repair of the napper 100 since only one person is required to remove a worker roll. Further, because the bearing cartridges 120 are subject to stresses resulting from both the worker roll's rotation and the simultaneous rotation of the cylinder 116, there is cyclic loading. In the present invention, this loading is lowered over similar steel rolls due to the reduced weight, thus increasing the mean time between failure (MTBF) since total loading is the key factor in determining bearing life.

The following tables illustrate the mechanical performance of the aluminum worker rolls:

Uniformly Loaded Beam analysis (Table -1 and Table-2)

| Input Values | | Output Values | |
|---|---|---|---|
| Section Area (A) | 3.502 $in^2$ | Weight of Tube (W) | 32.947 lbs. |
| Moment of Inertia (I) | 1.950 $in^4$ | Deflection | 0.049-in. |
| Material Density (D) | 0.098 lbs/$in^3$ | | |
| Beam Length (L) | 96 inches | | |
| Load (P) | 50 Lbs. | | |
| Modulus of Elasticity (E) | 100 ÷ 07 psi | | |

Table - 1 Uniformly Loaded Beam Analysis
Formula = $5*W*L^4/384*E*I$
50-lb Load Profile
A- 400-lb Load Profile

| Input Values: | | Output Values: | |
|---|---|---|---|
| Section Area (A) | 3.502 in 2 | Weight of Tube (W) | 32.947 lbs. |

-continued

| Uniformly Loaded Beam analysis (Table -1 and Table-2) | | | |
|---|---|---|---|
| Moment of Inertia (I) | 1.950 in 4 | Deflection | 0.256 in. |
| Material | 0.098 | | |
| Density (D) | lbs/in 3 | | |
| Beam Length (L) | 96 inches | | |
| Load (P) | 400 Lbs. | | |
| Modulus of Elasticity (E) | 1.00 + 07 psi | | |

| 80" Worker Roll | | | | 96" Worker Roll | | | |
|---|---|---|---|---|---|---|---|
| 25-lbs | 50-lbs | 75-lbs | 100-lbs | 25-lbs | 50-lbs | 75-lbs | 100-lbs |
| 0.014.0 | 0.0280 | 0.0420 | 0.0550 | 0.0200 | 0.0450 | 0.0630 | 0.0840 |
| 0.0080 | 0.0160 | 0.0250 | 0.0330 | 0.0120 | 0.0260 | 0.0380 | 0.0510 |

The gudgeons 152 are preferably constructed from machined steel. The inner portion is dimensioned to be pressed 6 inches into the inner tube 156 of the aluminum worker roll tube 150. The outer portions of the gudgeons extending axially from the center of the tube 150 to receive the bearing cartridges 120.

The bearing cartridges 120 comprise journaled inner sleeves 162 that are press fit onto the outer portions of the gudgeons 152. Outer sleeves 164 of cartridges 120 are generally cylindrical, but have two opposed flats 166, 168, which facilitate the connection of the worker rolls 108 to the cylinder heads 112, 114 of the cylinder 116.

3. Worker roll quick-release

Figure 3:
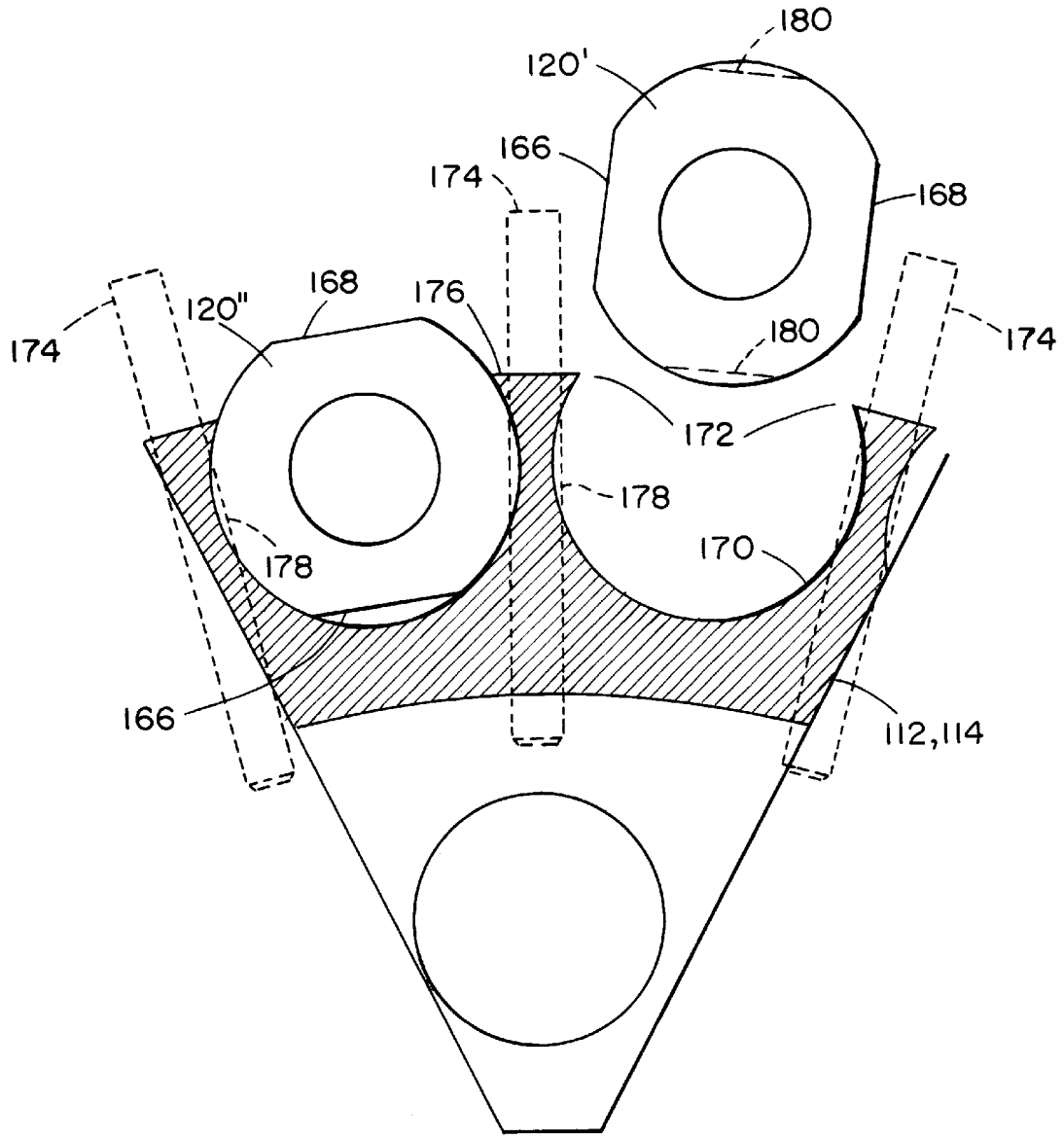
FIG. 3 is an end plan view of a section of a cylinder head and two exemplary bearing cartridges of the present invention in an entry position and locked in position.

FIG. 3 illustrates the quick release scheme for the worker roll attachment to the cylinder heads 112, 114. Spaced at equal intervals around the outer circumference of the cylinder heads are typically 18 to 30 bearing cartridge seats 170. These are partially circular cut out portions that are open (see reference numeral 172) in the radial direction.

The bearing cartridges 120 are inserted into the seats 170 by aligning them into an entry position (see bearing cartridge 120') such that the flats 166, 168 are aligned radially with respect to the associated cylinder head 112 or 114. In this orientation, the opening 172 in the seat 170 is such that it can accommodate the insertion or extraction of the bearing cartridges 120.

As illustrated by both FIGS. 2 and 3, to retain the bearing cartridge 120 in the seat 170 after its insertion, it is rotated +/−90 degrees. This aligns the flats 166, 168 tangentially with respect to the associated cylinder head 112, 114, see bearing cartridge 120". In this position, the bearing cartridge 120" is retained in the seat 170 of the cylinder head.

During operation, the bearing cartridges 120 are locked in the tangential orientation by the insertion of retaining pins 174. These retaining pins 174 are inserted into the tongues 176 that divide and define the seats 170. When depressed, button 184 releases ball-bearing locking elements 182 to enable insertion into the tongue hole 186. Release of the button 184 after full insertion locks the pin in the tongue hole 186 when the locking elements 182 expand into an annular relief within the holes 186. When inserted, the sidewalls 178 of the retaining pins 254 extend into the seats 170. Semicircular cross-sectioned cut-out portions or reliefs 180 of the bearing cartridges 120 engage the side walls 178 of the retaining pins 174, thus preventing rotation of the cartridges in the seats when in the locked position.

In the preferred embodiment, a piece of circular stamped steel with six air scoops is inserted on the gudgeon 152. The air scoops pull air into and out of the worker rolls 108 to flow past the internal web 154 as the roll rotates, providing internal cooling. This cooling extends the life of the carding wire cloth backing. Since the principal contributor to downtime and preventative maintenance is the replacement of worker roll wire, by extending the life of the wire cloth, this feature enhances productivity and reduces the cost of ownership for the napper.

4. Side-accessible fancies

Returning to FIG. 1, during operation, flock builds up on the worker roll carding 110. While some of the filaments of the fabric are raised into a nap that remains attached to the fabric web, some of the filaments are entirely separated from the fabric and bind to the carding.

This accumulated flock is removed by worker cleaner rolls 140, 142, commonly referred to as fancies. The fancies 140, 142 are located under the cylinder 116 and comprise bars that extend parallel to the longitudinal axes of both the cylinder 116 and the rotating worker rolls 108. The cleaner or fancy rolls carry densely packed semirigid filamentary material 144, commonly metal wire brush fillet, that intermeshes with the carding of the rolls 108 as they rotate on the cylinder 116 in proximity to the cleaner bars 140, 142. These cleaner rolls 140, 142 clean the flock off the worker rolls, and drop it into a pan (not shown) from which the flock is removed, usually by suction. The cleaner material 144 also conditions the wire on the worker rolls, helping to keep it sharp.

The cleaning action is achieved by driving the fancy cleaner bars 140, 142 to rotate in synchronism with the rotation of the worker rolls 108 and the cylinder 116. In order for the filamentary material, or of the cleaner fancies to remove the flock from the carding of the worker rolls without being damaged, the fancies must rotate such that the brush fillet is moving in the same direction as the carding wires of the worker rolls.

Figure 4A:
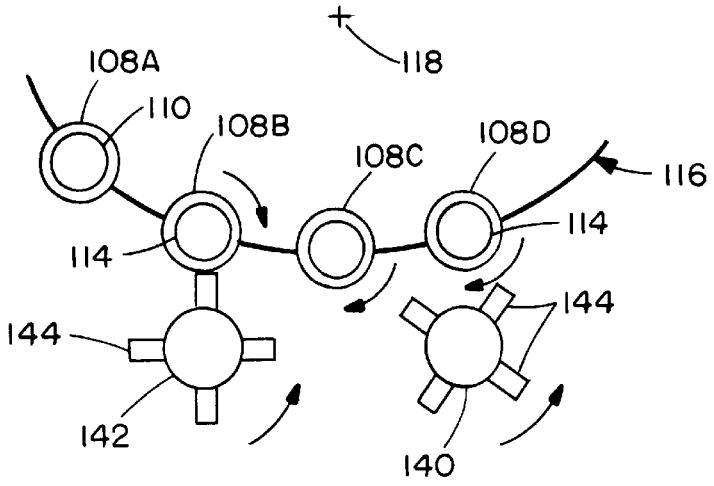
FIGS. 4A and 4B are schematic side views illustrating the cleaning action of the fancy cleaner rolls on the worker rolls.
Figure 4B:
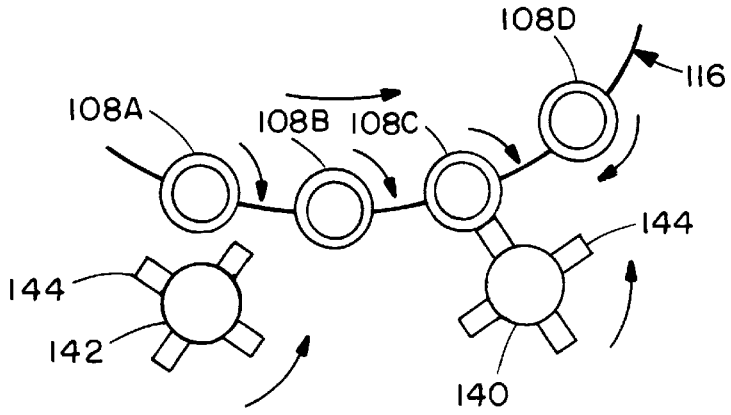

The synchronized movement of the fancies and worker rolls is illustrated in FIGS. 4A–4B. The brush fillet material 144 engages the carding 110 as the worker rolls are rotated around the axis 118 of cylinder 116. In the illustrated example, the worker rolls 108A–108B are arranged to rotate all counter to the direction of fabric progression, "counter-pile," around the cylinder 116. This is clockwise in the illustrated implementation. So that the brush fillet 144 of the fancies 140, 142 properly engages the carding 110 of the worker rolls 108, both fancies 140, 142 rotate counter-clockwise. The fancies are timed such that they each clean alternating rolls around the cylinder head's circumference, each fancy cleaning a different set of the rolls. This arrangement is illustrated in FIG. 4B which shows the relative orientation of the worker rolls 108A–D and the fancies 140, 142 an instant after the time frame of FIG. 4A.

Figure 5:
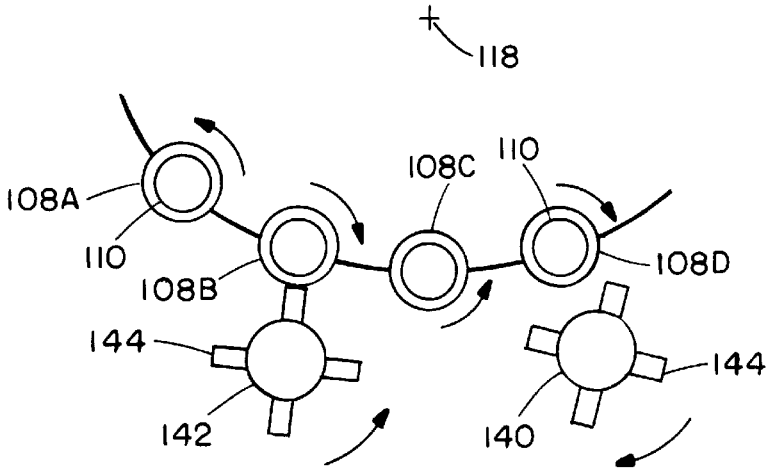
FIG. 5 is a schematic view illustrating the fancy cleaning action when the worker rolls are driven in alternating directions.

As shown in FIG. 5, the two fancy arrangement enables the invention to be reconfigured for the situation where worker rolls 108 alternate rotate with, "pile direction," and counter, counter-pile direction, to the direction of fabric travel. In this implementation, the fancies 140, 142 are driven so that one rotates counterclockwise to clean the clockwise rotating worker rolls, e.g., 108B, and the other fancy bar rotates clockwise to clean the counterclockwise rotating worker bars, e.g., 108D.

Figure 6:
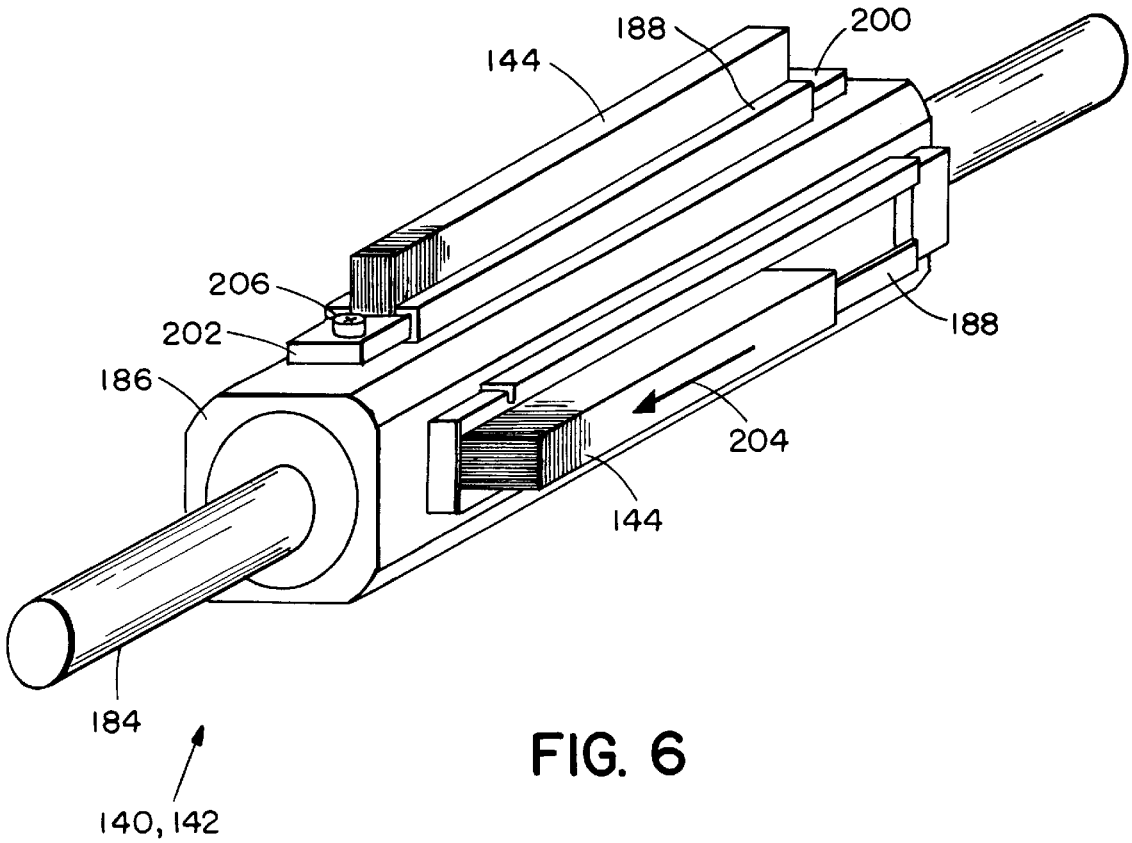
FIG. 6 is a perspective view illustrating the fancy cleaner bar of the present invention.

FIG. 6 is a perspective view illustrating one of the fancy cleaner bars 140, 142, which has been constructed according to the principles of the present invention. The fancy 140, 142 comprises a support bar 184. Centered on the support bar both longitudinally and axially is a cylinder body 186. The body's length L is sized to be somewhat longer than the width of the working surface of worker rolls 108. The cylinder body preferably has a square or substantially square cross section to facilitate the installation of four strips of the cleaning material 144 at evenly spaced intervals around its circumference.

Figure 7:
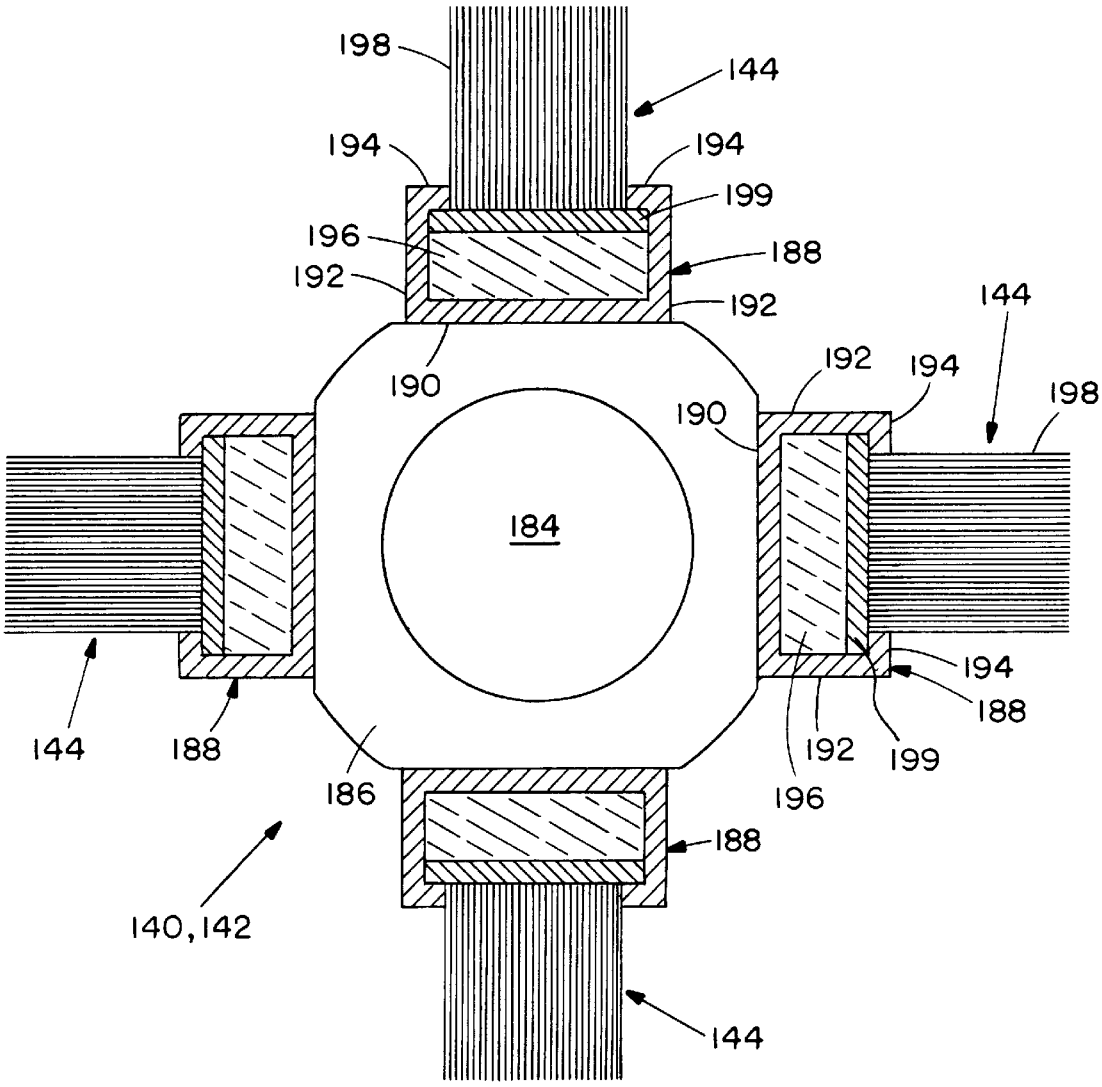
FIG. 7 is a cross-sectional view of the inventive fancy cleaner bar.

With reference to both FIG. 6 and FIG. 7, the cleaning material strips 144 are installed on the cylinder body 186 using four substantially U-shaped retaining slides 188, one for each strip 144 of cleaning material. Each retaining slide 188 has a lateral base member 190 that is fixed to a flat section of the cylinder body 186 and two side walls 192 that extend orthogonally from the base member 190. On top of each of these side members are lips 194 that extend inward, toward each other, closing off the slide's center channel.

The configuration of the retaining slides enables substantially T-shaped cleaning material strips 144 to be slid longitudinally into the slides 188. In more detail, the cleaning material strips 144 comprise support members 196 that are sized laterally to fit between the side members 192 of the slides 188 and sized in height to have sufficient clearance such that they fit between the base members 190 and the overhanging lips 194. The cleaning material filaments 198 or brush fillet is bonded to the supports 196 to extend substantially perpendicularly from them using a bonding material layer 199. The brush fillet 198 is centered to extend down the center of the supports such that it does not interfere with the lips 194 during insertion into or extraction from the slides 188.

The cleaning material strips 144 are retained in the slides during operation by a series of blocks. When removal, for example, is necessary, lock block 202 is first removed. In the illustrated implementation, the lock block 202 is secured to the cylinder body 186 via a bolt 206. Once removed, the strip 144 slides in the direction of arrow 204. This process is reversed for installation. Stop blocks 200, located at the distal ends of the retaining slides 188, keep the strips in the slides and also ensure proper centering.

The inventive configuration facilitates fancy maintenance. Traditionally, this process has required a lengthy shut-down of the machine. Conventional fancies are usually made of wood fillet strips that are bolted to the cleaner roll with ten or twelve bolts. Releasing a fillet strip thus took a great deal of time and unpleasant effort, with an operator lying under the machine for several hours. In contrast, the inventive system enables fancy material to be accessed from the side of the machine 100 by simply removing one bolt and sliding the material out of the retaining slides and through access ports 208 in the left and right end-pieces 104, 106 of the frame 102 (refer to FIG. 1).

Figure 8:
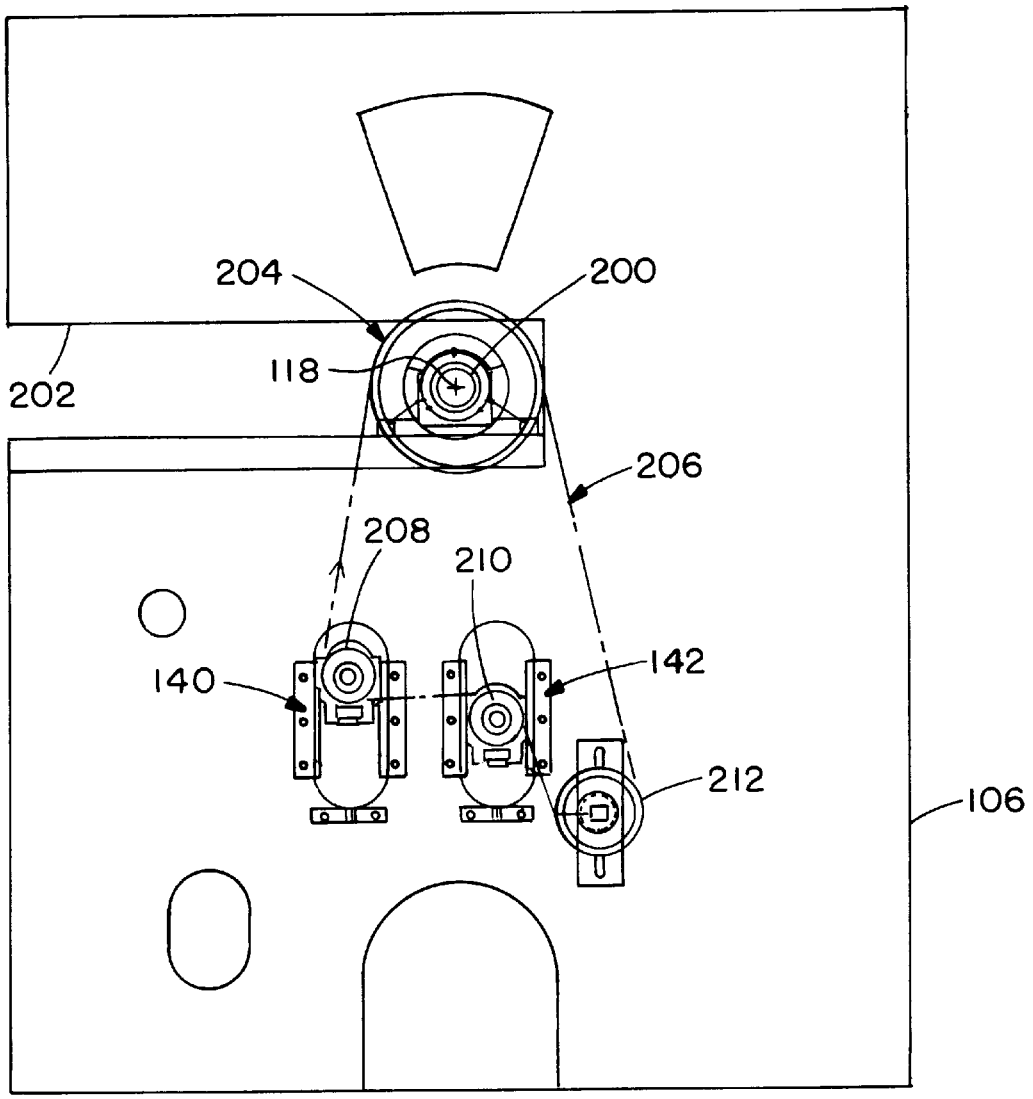
FIG. 8 is a plan view of the right side of the machine showing the path for the fancy timing belt.

FIG. 8 is a right side plan view showing the pulley arrangement for driving the fancies 140, 142 in synchronism with the rotation of the cylinder 116. The cylinder axle 200 extends transversely through the right end-piece 106 via the installation slot 202. A cylinder pulley 204 is connected to the cylinder axle 200 to rotate with it. A torque protection device is preferably used in the mechanical connection between the axle and the cylinder pulley 204. The fancy timing belt 206 raps around the cylinder pulley 204 and then around first and second fancy timing belt pulleys 208, 210. These fancy timing belt pulleys 208, 210 drive fancies 140 and 142, respectively. From the second pulley 210, the timing belt 206 raps around idler pulley 212 before returning to the cylinder axle pulley 204. In the illustrated configuration, the timing belt passes clockwise around the first fancy pulley 208 and counterclockwise around the second fancy pulley 210 to drive the fancies in different directions to thus operate with pile and counter-pile worker rolls.

5. Drive belt arrangement

FIGS. 9, 10A, 10B, and 11 illustrate the drive belt arrangement that is used to drive the worker rolls 108 in the pile and counter-pile directions.

Figure 9:
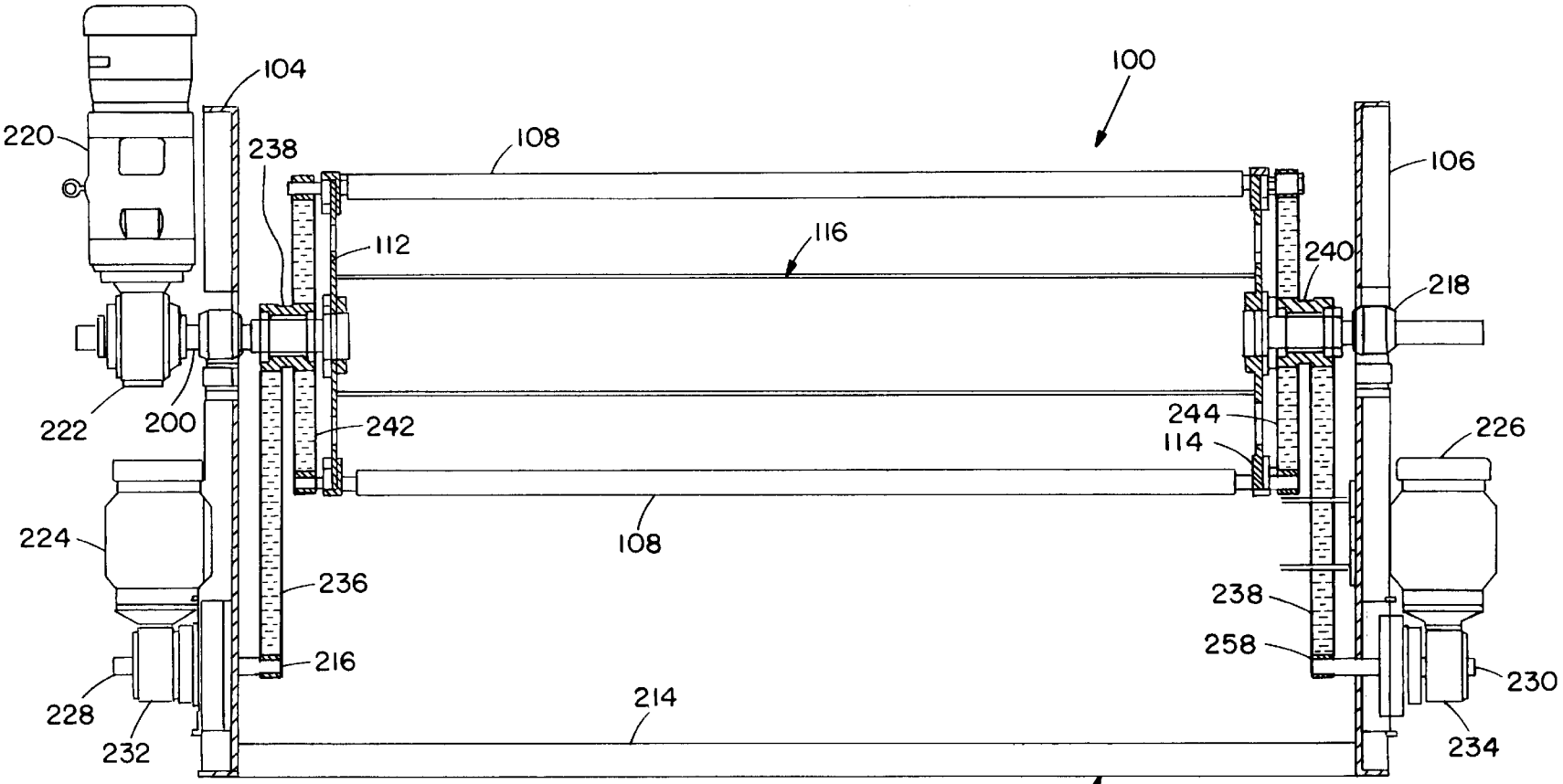
FIG. 9 is a front plan view of the machine highlighting the drive and worker roll belt arrangement for the worker rolls.

FIG. 9 is a front, simplified view of the machine 100. As generally touched on previously, the machine's frame 102 comprises left and right end-pieces 104, 106 that project upwards from a base 214 to generally support the cylinder 116 and its drive components. Specifically, the axle 200 of the cylinder 116 is supported by the left and right end-pieces 104, 106 by cylinder bearings 216, 218. The cylinder axle 200 is driven to rotate by cylinder motor 220 via reducing gear case 222.

Generally, two motors, specifically, counter-pile motor 224 and pile motor 226 are used to drive the worker rolls 108. Each pile motor 224, 226 are attached to the respective outer sides of the left and right end-pieces 104, 106 and drive belt spindles 228, 230 that project inwardly through the end pieces 104, 106. The pile motors 224, 226 drive the belt directly via a spindle from motors 224, 226 or indirectly via an arrangement of gearboxs 232, 234.

The belt spindles 228 and 230 drive a counter-pile drive belt 236 and a pile drive belt 238 via counter-pile drive pulley 246 and pile drive pulley 258, respectively. The counter-pile drive belt 236 passes over a left cylinder-axle sleeve 238, which is journaled to the cylinder axle 200, enabling it to rotate independently of the cylinder axle. Similarly, the pile drive belt 238 passes over a right cylinder-axle sleeve 240 that is similarly journaled to the cylinder axle 200.

A counter-pile worker-roll drive belt 242 passes over the left axle sleeve 238 and the worker rolls 108 that rotate in the counter-pile direction. In a similar manner, the pile worker roll drive belt 244 passes over the right axle sleeve 240 and the pile-direction worker rolls 108 to drive those worker rolls.

Figure 10A:
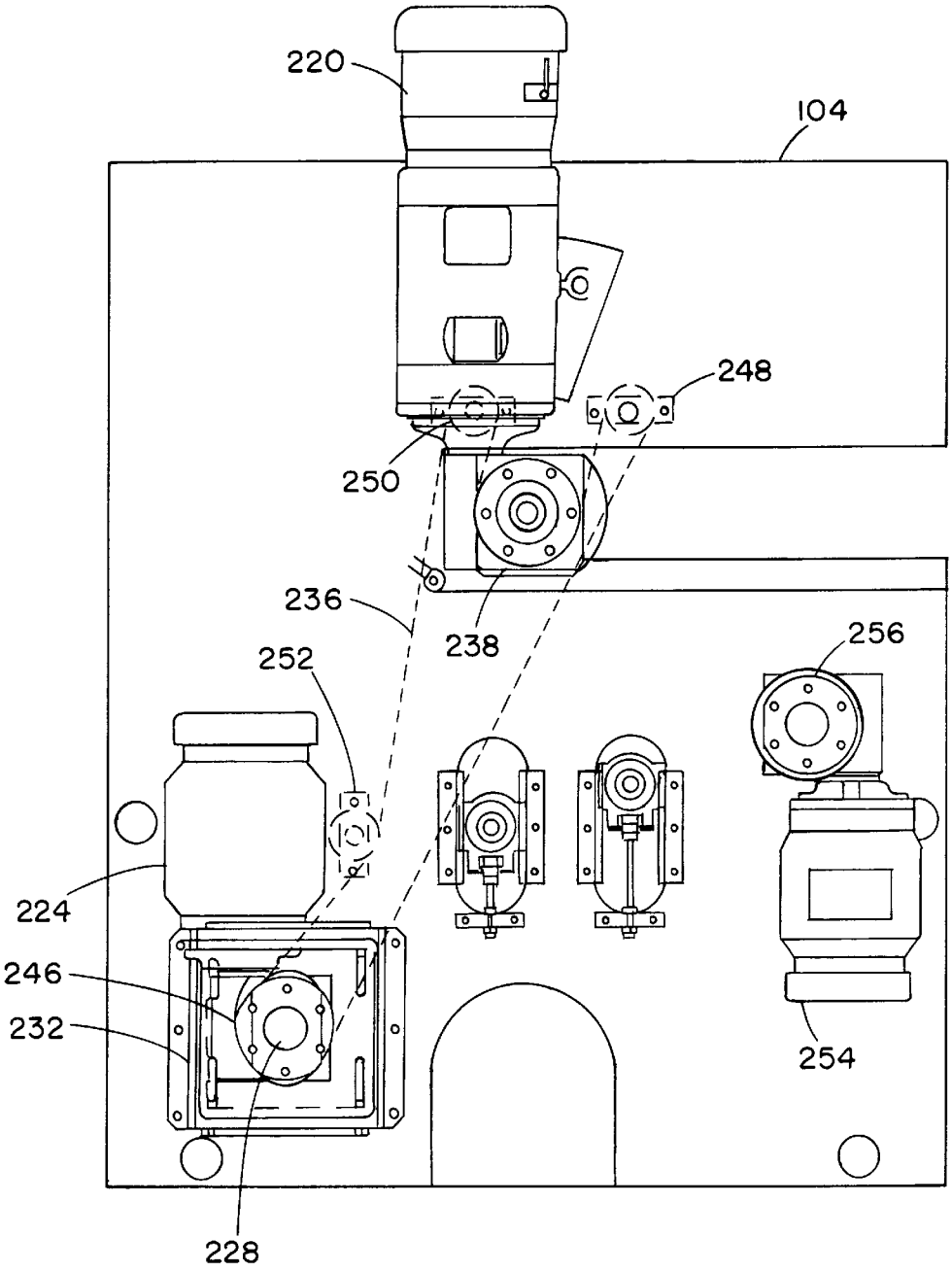
FIG. 10A and 10B are plan views of the left and right end-pieces of the machine, respectively, showing the counter-pile and pile drive belt paths.

FIG. 10A shows the belt path for the counter-pile drive belt 236. Specifically, the belt 236 passes over the counter-pile drive pulley 246 passes upward to a first counter-pile drive idler pulley 248 around the left axle sleeve 238, around a second counter-pile drive idler pulley 250, down to a redirecting counter-pile drive idler pulley 252, and back to the counter-pile drive pulley 246.

Also shown in FIG. 10A is a upstream draft roll drive motor 254 and draft roll reducer 256 for driving the upstream draft roll 126 of the machine 100.

Figure 10B:
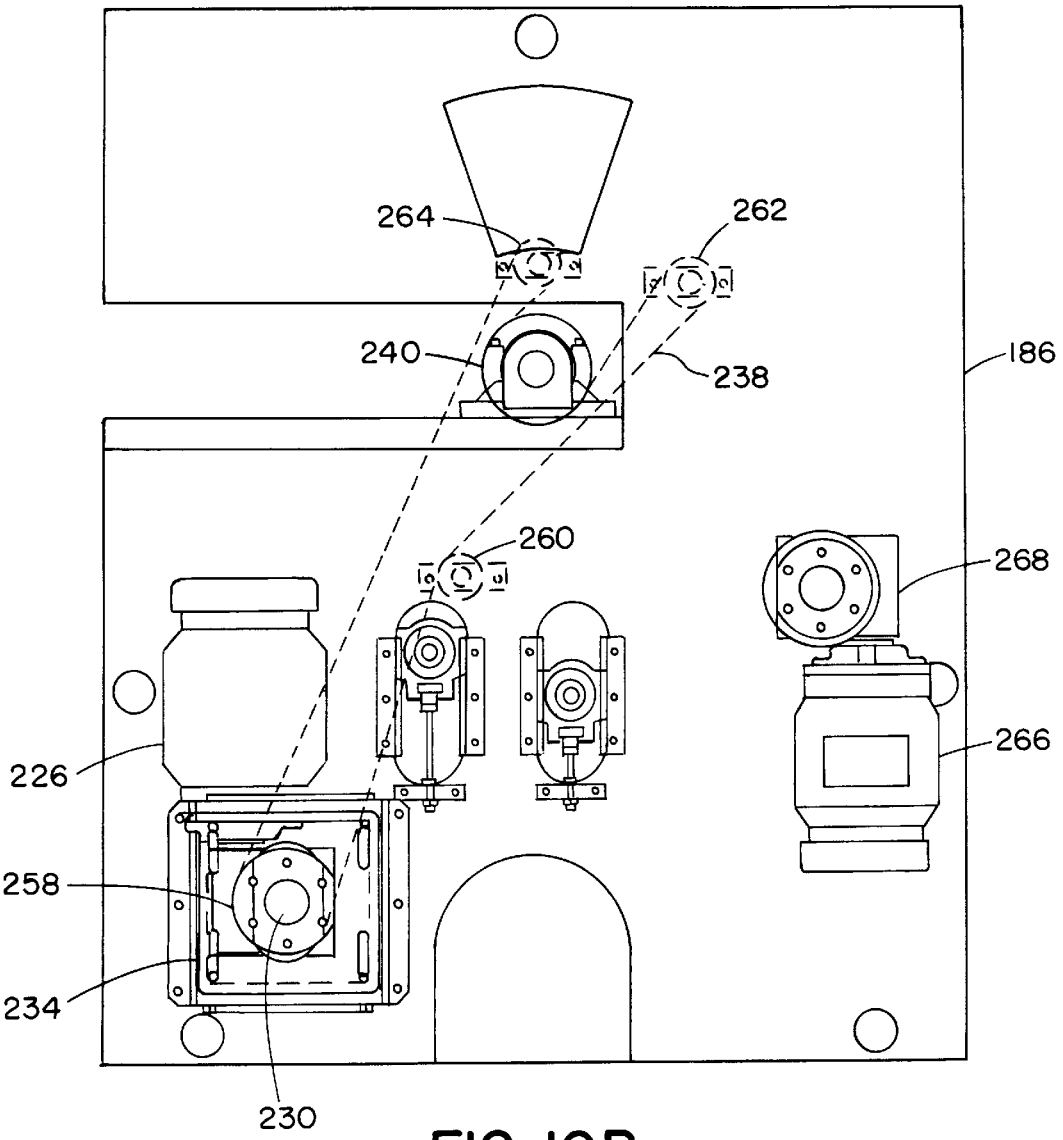

Similarly, FIG. 10B shows the pile side path for the pile drive belt 238. Specifically, the pile drive motor 226 drives the spindle 230 to power the pile side drive pulley 258 via the gear case reducer 234. The pile side drive belt 238 passes upward to a first pile side drive idler pulley 264, around the right axle sleeve 240, to a second pile side drive idler pulley 262, and back past a redirecting pulley 260 to the drive pulley 258.

Also shown in FIG. 10B is the downstream draft roll drive motor 266 and the downstream draft roll reducer 268 for driving the draft 132.

Figure 11:
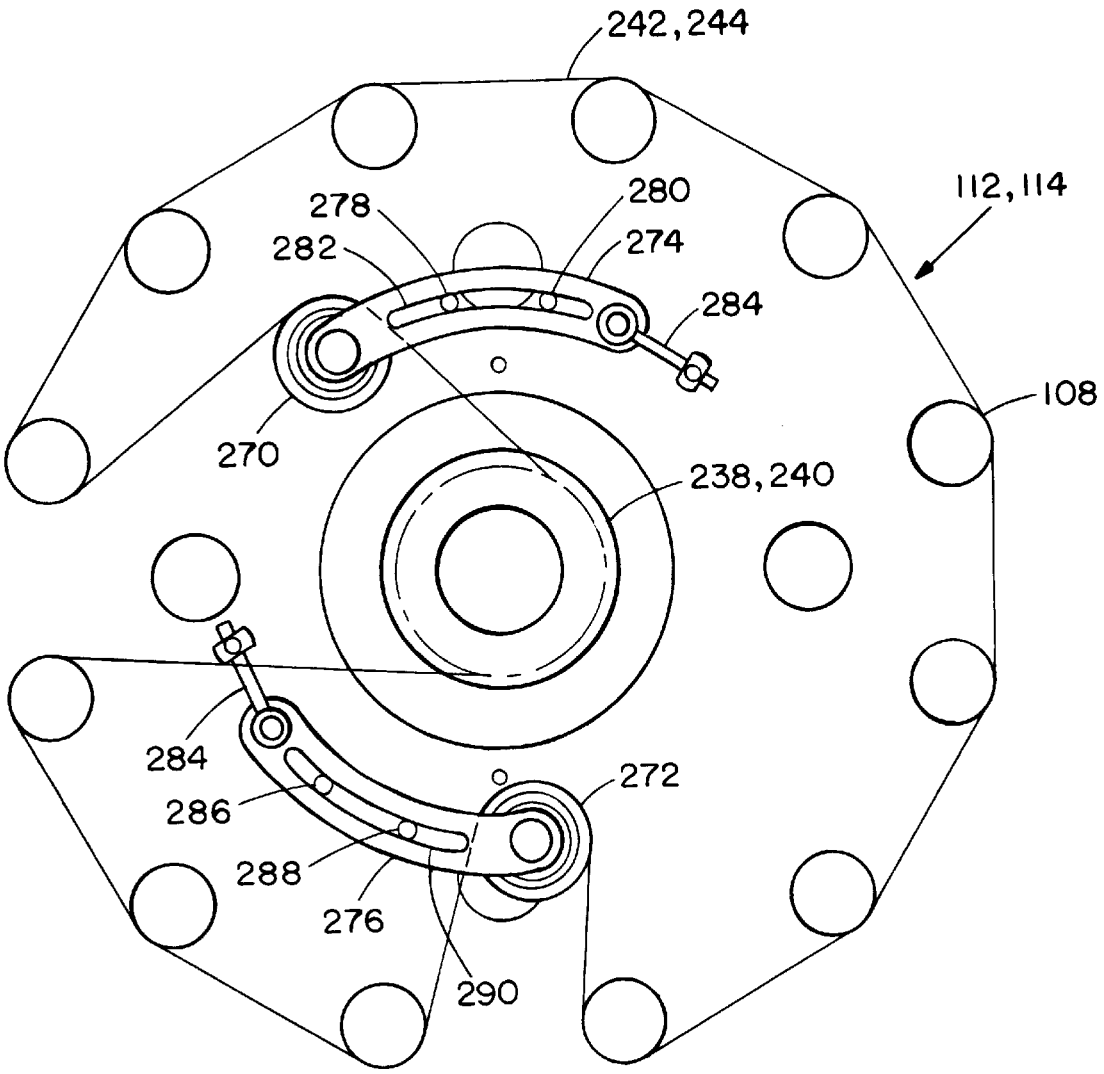
FIG. 11 is a simplified side plan view showing the worker roll drive belt path.

FIG. 11 shows the path of the counter-pile worker roll drive belt 242. (The path of the pile worker roll drive belt 244 is the same but for being reflected.) The worker roll drive belt passes over its respective axle sleeve 238, 240 to a first tensioning pulley 270. From this pulley it passes over either all of the counter-pile worker rolls in the case of the counter-pile side or all of the pile worker rolls in the case of the pile side. After passing over eight worker rolls in the illustrated 24 total worker roll embodiment, the worker roll drive belt 242, 240 passes over a second tensioning pulley 272. And then over the three remaining worker rolls and back to the axle sleeve 238, 240.

Both of the first and second tensioning pulleys 270, 272 are held on respective idler arms 274, 276. For example, the first tensioning pulley idler arm 274 is constrained to only move in an arcuate direction via pins 278, 280 that are rigidly attached to the corresponding cylinder head 112, 114. The pins 278, 280 engage an arcuate track 282 in the idler arm 274. In idler arm adjustment arm 284 extends from the first idler arm 274 to the corresponding cylinder head 112, 114. By adjusting the length of the adjustable arm 284, the first idler pulley 270 is moved with respect to the cylinder head 112, 114 to tension the belt 242, 244. In a similar manner, the second tensioning pulley 272 is moved to tension the belt via the second idler arm adjustment arm 284 by the interaction between pins 286, 288 and the track or slot 290 in the second idler arm 276.

As a result of this configuration, the tension on the worker roll drive belts is releasable to enable removal of those belts without requiring any further disassembly of the worker rolls or the cylinder 116. In contrast in the past, the worker roll drive belts have completely wrapped around the cylinder's axle requiring removal or disassembly of the cylinder to change the belt.

6. Carding wire wear monitoring

According to another aspect of the invention, the torque generated by each of the worker roll drive motors 224, 226 is detected with a torque monitor, preferably in the motors' electrical circuits. This system is used to monitor the degradation of the hooked or straight wire carding of the worker rolls. Although the carding is made typically from stiff wires that have been hardened, months of constant fabric processing yields slow wearing. At some point in the wear pattern, the carding is no longer of sufficient length and/or sharpness to properly develop the nap on the processed fabric. At this stage, the carding must be replaced or reconditioned. According to the invention, carding wear is detected by monitoring the absolute torque and change in the torque over time produced by the motor. For fabric of the same surface characteristics, the torque required by the worker roll drive motors 224, 226 over time will increase with increased carding wear.

Figure 12:
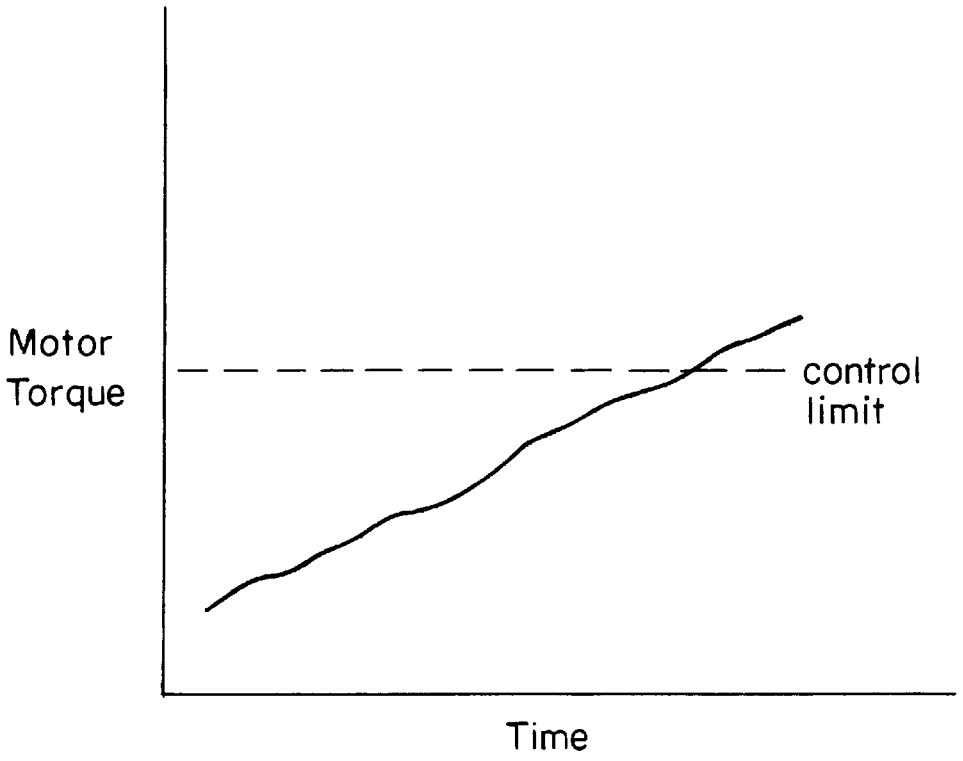
FIG. 12 is a plot of motor torque, current, as a function of time showing the effects of carding deterioration.

FIG. 12 is a plot of worker roll drive motor torque. In the preferred embodiment, generated torque is detected by measuring motor current consumption, which is generally linear with generated torque. Typically, over the course of several months, an increase in the motor's torque while producing the same results will be detected as a consequence of carding wear. In the preferred embodiment, an alarm or signal to a control panel is generated when the worker roll motor torque/current exceeds a predetermined threshold (TH). This action indicates to the operator that carding has worn to the point where it is insufficiently processing the fabric and should be replaced.

While this invention has been particularly shown and described with references to preferred embodiments thereof, it will be understood by those skilled in the art that various changes in form and detail may be made therein without departing from the spirit and scope of the invention as defined by the appended claims.

What is claimed is:

1. A fabric processing machine including a system of attaching worker rolls to a cylinder, the system comprising:

a plurality of seats formed in at least one cylinder head;

bearing cartridges of the worker rollers that are insertable into the seats and lockable therein;

wherein at least one worker roll is constructed from aluminum and comprises an internal web constructed from a single unitary piece of extruded aluminum, the internal web comprising an inner tube and radial splines extending radially from the inner tube to an outer tube of the roll.

2. A fabric processing machine including a system of attaching worker rolls to a cylinder, the system comprising:

a plurality of seats formed in at least one cylinder head;

bearing cartridges of the worker rolls that are insertable into the seats and lockable therein; and an intercooler that forces air through at least one worker roll constructed of aluminum as it rotates.

3. A fabric processing machine including a system of attaching worker rolls to a cylinder, the system comprising:

a plurality of seats formed in at least one cylinder head of the cylinder; and bearing cartridges of the worker rolls that are insertable into the seats and lockable therein, wherein the bearing cartridges rotate in the seats after insertion to be retained in seats.

4. A fabric processing machine as recited in claim 3, wherein at least one worker roll is constructed from aluminum.

5. A fabric processing machine as recited in claim 4, wherein the fabric processing machine is a napper.

6. A fabric processing machine as recited in claim 4, wherein the worker roll is constructed from extruded aluminum.

7. A fabric processing machine as recited in claim 4, wherein the worker roll comprises an internal web.

8. A fabric processing machine as recited in claim 4, wherein the internal web includes an inner tube and radial splines extending radially from the inner tube to an outer tube of the roll.

9. A fabric processing machine as recited in claim 4, further comprising carding that is applied to an outer surface of the worker roll.

10. A fabric processing machine as recited in claim 2, wherein each worker roll comprises:

an aluminum tube; and a working surface applied to the outer circumference of the aluminum tube for engaging and processing a fabric.

11. A fabric processing machine as recited in claim 10, wherein the working surface comprises densely packed wire carding for developing a nap on the surface of the fabric.

12. A fabric processing machine as recited in claim 11, wherein the wire carding is held in a tape that is adhered to the aluminum tube.

13. A fabric processing machine as recited in claim 10, wherein the aluminum tube comprises an inner web.

14. A worker roll as described in claim 10, further comprising gudgeons press fit axially into either end of the aluminum tube for connecting the bearing cartridge to the aluminum tube.

15. A fabric processing machine as recited in claim 14, wherein outer surfaces of the bearing cartridges comprise at least one flat that enables insertion of the bearing cartridges into seats within the cylinder head that carries multiple ones of the worker rolls.

16. A fabric processing machine as recited in claim 15, wherein outer surfaces of the bearing cartridges comprise at least one flat for providing clearance to enable the bearing cartridges to be inserted into the seats of the cylinder head.

17. A fabric processing machine as recited in claim 3, further comprising retaining pins that engage the bearing cartridges to prevent rotation and thereby maintain the cartridges in a locked relationship to the cylinder head.

18. A method for attaching worker rolls of a fabric processing machine to a cylinder, the method comprising:

inserting bearing cartridges of the worker rolls into seats formed in a cylinder head of the cylinder; and retaining the bearing cartridges of the worker rolls in the seats by rotating the bearing cartridges in the seats.

19. A method as described in claim 18, further comprising locking the bearing cartridges in the seats.

20. A method as described in claim 18, wherein the step of inserting the bearing cartridges in the seats comprises aligning the cartridges to enable the insertion into the seats.

21. A method as described in claim 18, further comprising locking the bearing cartridges in the seats by preventing rotation of the cartridges.

22. A method as described in claim 21, wherein locking the bearing cartridges comprises inserting retaining pins in the cylinder head that engage the bearing cartridges.

* * * * *

UNITED STATES PATENT AND TRADEMARK OFFICE

CERTIFICATE OF CORRECTION

PATENT NO. : 6,058,582
DATED : May 9, 2000
INVENTOR(S) : Joseph M. Gardner and Willis J. Antonovich It is certified that error appears in the above-identified patent and that said Letters Patent is hereby corrected as shown below:

Column 4, line 65, delete "3.502 in 2" and substitute --3.502 in^2-- therefor;
Column 5, line 5, delete "1.950 in 4" and substitute --1.950in^4-- therefor;
Column 5, line 8, delete "lbs/in 3" and substitute --lbs/in^3-- therefor;
Claim 8, line 1, delete "4" and substitute --7-- therefor;
Claim 10, line 1, delete "2" and substitute --3-- therefor; and
Claim 16, line 1, delete "15" and substitute --3-- therefor.

Signed and Sealed this

Twentieth Day of March, 2001

Nicholas P. Godici

*Attest:*

NICHOLAS P. GODICI

*Attesting Officer*

*Acting Director of the United States Patent and Trademark Office*